US007825174B2

(12) United States Patent
Berndt et al.

(10) Patent No.: US 7,825,174 B2
(45) Date of Patent: Nov. 2, 2010

(54) ELECTRICALLY CONDUCTIVE STRANDS, FABRICS PRODUCED THEREFROM AND USE THEREOF

(75) Inventors: Kurt-Günter Berndt, Graben (DE); Rex Delker, Wehringen (DE); Hubert Rathay, Kunigsbruna (DE)

(73) Assignee: Teijin Monofilament Germany GmbH

( * ) Notice: Subject to any disclaimer, the term of this patent is extended or adjusted under 35 U.S.C. 154(b) by 76 days.

(21) Appl. No.: 12/070,818

(22) Filed: Feb. 21, 2008

(65) Prior Publication Data

US 2008/0207800 A1 Aug. 28, 2008

(30) Foreign Application Priority Data

Feb. 24, 2007 (DE) ..... 10 2007 009 119

(51) Int. Cl.
*C08K 7/02* (2006.01)

(52) U.S. Cl. ..... 523/222; 524/495

(58) Field of Classification Search ..... 523/222; 524/495

See application file for complete search history.

(56) References Cited

U.S. PATENT DOCUMENTS

| | | | | |
|---|---|---|---|---|
| 2008/0207074 | A1 | 8/2008 | Berndt et al. | 442/184 |
| 2008/0207799 | A1 | 8/2008 | Berndt et al. | 523/222 |
| 2009/0117800 | A1 * | 5/2009 | Nakatsuka et al. | 442/199 |
| 2009/0182070 | A1 * | 7/2009 | Miyazono et al. | 523/523 |

FOREIGN PATENT DOCUMENTS

| | | | |
|---|---|---|---|
| DE | 691 23 510 | T2 | 4/1994 |
| DE | 690 07 517 | T2 | 10/1994 |
| DE | 102 96 500 | T5 | 4/2004 |
| DE | 600 16 136 | T2 | 8/2005 |
| EP | 0 387 395 | A2 | 9/1990 |
| EP | 0 674 029 | A1 | 9/1995 |
| EP | 0 735 165 | A2 | 10/1996 |
| EP | 1 599 815 | A2 | 8/2005 |
| WO | WO 98/14647 | | 4/1998 |

OTHER PUBLICATIONS

Columbian Chemicals Company brochure entitled "Raven Blacks", Industrial Carbon Black Applications and Typical Properties of Industrial Carbon Blacks (6 sheets).

* cited by examiner

*Primary Examiner*—Edward J Cain
(74) *Attorney, Agent, or Firm*—Michael W. Ferrell

(57) ABSTRACT

Described are melt-spun strands having a modulus of elasticity of from 8 to 14 GPa and an elastic extension of up to 1.5%, comprising a) a thermoplastic polyester, b) a thermoplastic elastomeric block copolymer, and c) carbon black and/or graphite particles in the form of aggregates aligned along the longitudinal axis of the strand which form electrically conductive paths along the longitudinal axis of the strand. The strands exhibit very high electrical conductivity and are useful for forming screens, wires, sieves or other technical/industrial wovens.

25 Claims, No Drawings

ELECTRICALLY CONDUCTIVE STRANDS, FABRICS PRODUCED THEREFROM AND USE THEREOF

CLAIM FOR PRIORITY

This application is based upon German Patent Application No. DE 10 2007 009 119.4, entitled "Elektrisch leitfaähige Fäden, daraus hergestelite Flächengebilde und deren Verwendung", filed Feb. 24, 2007. The priority of German Patent Application No. DE 10 2007 009 119.4 is hereby claimed and its disclosure incorporated herein by reference.

TECHNICAL FIELD

The present invention concerns strands having very high electrical conductivities and excellent mechanical properties. These strands, which are monofilaments in particular, are useful in screens or conveyor belts for example.

BACKGROUND

It is known that polyester fibers for industrial applications are in most cases subjected to high mechanical and or thermal stressors in use. In addition, there are in many cases stressors due to chemical and other ambient influences, to which the material has to offer adequate resistance. As well as adequate resistance to all these stressors, the material has to possess good dimensional stability and constancy for its stress-strain properties over very long use periods. Nor may an electrostatic charge build up on the material during processing and in use.

One example of industrial applications comprising a combination of high mechanical, thermal, chemical and electrical stresses is the use of monofilaments in filters, screens or as conveyor belts. This use requires monofilaments having excellent mechanical properties, such as high initial modulus, breaking strength, knot strength, loop strength and also high abrasion resistance coupled with high hydrolysis resistance in order that they may withstand high stresses encountered in their use and in order that the screens or conveyor belts may have an adequate use life.

Industrial manufacturers, such as paper makers or processors, utilize filters or conveyor belts in operations taking place at elevated temperatures and in hot moist environments. Polyester-based manufactured fibers have a proven record of good performance in such environments, but when used in hot moist environments polyesters are vulnerable to mechanical abrasion as well as hydrolytic degradation.

Abrasion can have a wide variety of causes in industrial uses. For instance, the sheet-forming wire screen in papermaking machines is in the process of dewatering the paper slurry pulled over suction boxes, and this results in enhanced wear of the wire screen. At the dry end of the papermaking machine, wire screen wear occurs as a consequence of speed differences between the paper web and the wire screen surface and between the wire screen surface and the surface of the drying drums. Fabric wear due to abrasion also occurs in other industrial fabrics, for instance in transportation belts due to dragging across stationary surfaces, in filter fabrics due to the mechanical cleaning and in screen printing fabrics due to the movement of a squeegee across the screen surface.

The forming wire screens of state of the art papermaking machines utilize multi-ply woven fabrics. To maximize the speed of dewatering the paper, suction boxes are utilized on the wire screen underside to speed paper web dewatering by means of underpressure. The contact surfaces of the edges of these suction boxes with the forming fabric consist in general of ceramic to prevent excessive wear of the suction boxes.

On the other hand, the high manufacturing speeds, the rubbing due to the fillers added to the monofils and the sucking effect of the papermaking machine lead to high wear on the underside of the multi-ply forming fabric.

Monofilaments made of nylon, for example nylon-6 or nylon-6,6, are still being used to improve the abrasion resistance of the wire screen underside. This is where it is predominantly monofilaments made of polyethylene terephthalate (hereinafter PET) which are used because of their higher dimensional stability, and it is of them that the forming wire screen fabric consists essentially. One tried and tested construction for the wire screen underside is that of an alternating weft in which a backing weft of a nylon monofil alternates with a backing weft of PET monofil. This results in a compromise of abrasion resistance and dimensional stability.

The higher water imbibition of nylons compared with PET leads to lengthening of the weft threads in operation of the wire screen. As a result, the wire screens are prone to the undesirable effect known as edge curling in that they curl up at the edges and no longer lie flat within the papermaking machine.

There have been numerous attempts to replace nylon monofilaments with monofilaments made of other abrasion-resistant polymers that have a low water imbibition as well as being deformation resistant.

An example is monofilaments made of PET blends admixed with 10-40% of thermoplastic polyurethane (TPU) (cf. for example EP-A-387,395). Similarly, mixtures of thermoplastic polyester, for example polyethylene terephthalate isophthalate, and thermoplastic polyurethane having melting points of 200 to 230° C. have been used (cf. for example EP-A-674,029).

The prior art further comprises monofilaments having a core-sheath structure in each of which the sheath consists of a mixture of thermoplastic polyester having a melting point of 200 to 300° C., for example PET, and of thermoplastic elastomeric copolyetherester having selected polyetherdiol building block groups as soft segments, that likewise exhibit improved abrasion resistance (cf. for example EP-A-735,165).

Further polyester compositions comprising crystalline thermoplastic polyester resins, polyester elastomers and sorbitan esters are known from DE 691 23 510 T2. These are notable for good moldability, in particular for good releaseability.

DE 690 07 517 T2 discloses polyester compositions comprising an aromatic polycarbonate, a polyester derived from alkanediol and benzene-dicarboxylic acids, and a polyesterurethane elastomer or a polyether imide ester elastomer. These combine improved flow properties with good mechanical properties.

While these prior art strands do provide adequate abrasion resistance, electrical conductivity still leaves something to be desired in many cases. True, it has long been known that carbon black can be incorporated in strands to improve electrical conductivity. However, prior art solutions typically only provide electrical conductivities of up to $10^{-6}$ siemens/cm. When prior art carbon blacks are used to enhance electrical conductivity, it is found that when the strands produced are drawn the conductive paths formed by the carbon black are interrupted, and that a distinct reduction in electrical conductivity occurs as a result.

WO-A-98/14,647 describes an attempt to remedy this disadvantage by producing a sheath-core filament comprising a sheath polymer having a lower melting point than the core polymer. After drawing, the sheath is incipiently melted, so that the strand shrinks and interrupted bridges of electrically conductive material can re-form. This does indeed push electrical conductivity back up; however, the thermal treatment leads to a decrease in the degree of orientation of the molecular chains and hence to a reduction in the strength of the filament.

EP-A-1,559,815 describes coating a ready-produced strand with a mixture of carbon nanotubes and a polymer. Since the coated strand is not further stretched, the carbon bridges in the amorphous coating are not ruptured, which results in very good electrical conductivities.

SUMMARY OF INVENTION

The present invention has for its object to provide strands having outstanding electrical conductivity as well as good mechanical properties and excellent abrasion resistance.

It has now been found that, surprisingly, strands comprising a selected combination of matter have this property portfolio.

The present invention accordingly provides melt-spun strands having a modulus of elasticity of from 8 to 14 GPa and an elastic extension of up to 1.5%, comprising: a) a thermoplastic polyester, b) a thermoplastic elastomeric block copolymer and c) carbon black and/or graphite particles in the form of aggregates aligned along the longitudinal axis of the strand which form electrically conductive paths along the longitudinal axis of the strand.

DETAILED DESCRIPTION

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

The term "strands" herein is to be understood as referring very generally to fibers of finite length (staple fibers), fibers of infinite length (filaments) and also multifilaments composed thereof, or yarns secondarily spun from staple fibers. The melt-spun strands are preferably used in the form of monofilaments.

"Modulus of elasticity" herein refers to the secant modulus of the stress-strain curve between 0% and 1% strain.

"Elastic extension" herein refers to the linear course of the stress-strain curve from its origin to its departure from linearity. An elastic extension of 0.5% thus corresponds to a linear course of the stress-strain curve from 0% to 0.5% strain; an elastic extension of 1.5% consequently indicates a linear course of the stress-strain curve from 0% to 1.5%.

In accordance with the present invention, the polyesters used for component a) are fiber-forming polyesters which, after spinning, drawing and, if appropriate, relaxing, give strands having the above-described moduli of elasticity and elastic extensions.

In general, possibilities include polyethylene terephthalate homopolymers or copolymers containing ethylene terephthalate units. These polymers are therefore derived from ethylene glycol and, if appropriate, further alcohols and from terephthalic acid or polyester-forming derivatives thereof, such as terephthalic esters or terephthaloyl chlorides.

These thermoplastic polyesters are known per se. Building blocks of thermoplastic copolyesters a) are preferably the abovementioned diols and dicarboxylic acids, or correspondingly constructed polyester-forming derivatives. The main acid constituent of the polyesters comprises terephthalic acid, if appropriate, together with relatively small fractions, preferably up to 15 mol %, based on the total amount of dicarboxylic acids, of other aromatic and/or aliphatic and/or cycloaliphatic dicarboxylic acids, preferably with para- or trans-disposed aromatic compounds, for example 2,6-naphthalenedicarboxylic acid or 4,4'-biphenyldicarboxylic acid, and also preferably with isophthalic acid and/or with aliphatic dicarboxylic acids, such as with adipic acid or sebacic acid.

Suitable dihydric alcohols can be used as well as ethylene glycol. Typical representatives thereof are aliphatic and/or cycloaliphatic diols, for example, propanediol, 1,4-butanediol, cyclohexanedimethanol or mixtures thereof.

Examples of preferred components a) are copolyesters which, as well as polyethylene terephthalate units, contain further units which are derived from alkylene glycols, in particular ethylene glycol, and aliphthalic and/or aromatic dicarboxylic acids, such as adipic acid, sebacic acid or isophthalic acid.

Particularly preferred components a) are polyethylene terephthalate homopolymers or copolymers containing, as well as structural repeat units of polyethylene terephthalate, structural repeat units of polyethylene adipate, polyethylene sebacate or in particular of polyethylene isophthalate.

The polyesters used according to the present invention for component a) typically have solution viscosities (IV values) of at least 0.60 dl/g, preferably of 0.60 to 1.05 dl/g, and more preferably of 0.62-0.93 dl/g (measured at 25° C. in dichloroacetic acid (DCE)).

Preference is given to strands of polyesters having a free carboxyl group content of not more than 3 meq/kg.

These preferably comprise an agent for capping free carboxyl groups, for example a carbodiimide and/or an epoxy compound.

Polyester strands thus endowed are stable to hydrolytic degradation and are particularly suitable for use in hot moist environments, in particular in papermaking machines or as filters.

The thermoplastic and elastomeric block copolymers of component b) may comprise a wide variety of types. Such block copolymers are known to one skilled in the art.

Examples of components b) are thermoplastic and elastomeric polyurethanes (TPE-Us), thermoplastic and elastomeric polyesters (TPE-Es), thermoplastic and elastomeric polyamides (TPE-As), thermoplastic and elastomeric polyolefins (TPE-Os) and thermoplastic and elastomeric styrene block copolymers (TPE-Ss).

The thermoplastic and elastomeric block copolymers b) may be constructed from a wide variety of different monomer combinations. The blocks in question generally comprise so-called hard and soft segments. Soft segments are typically derived from polyalkylene glycol ethers in the case of the TPE-Us, the TPE-Es and the TPE-As. Hard segments are typically derived from short-chain diols or diamines in the case of the TPE-Us, the TPE-Es and the TPE-As. As well as from diols or diamines, the hard and soft segments are constructed from aliphatic, cycloaliphatic and/or aromatic dicarboxylic acids or diisocyanates.

Examples of thermoplastic polyolefins are block copolymers comprising blocks of ethylene-propylene-butadiene and of polypropylene (EPDM/PP) or of nitrile-butadiene and of polypropylene (NBR/PP).

Thermoplastic and elastomeric styrene block copolymers are particularly preferred components b). Examples are block copolymers comprising blocks of styrene-ethylene and of propylene-styrene (SEPS) or of styrene-ethylene and of butadiene-styrene (SEBS) or of styrene and of butadiene (SBS).

Thermoplastic and elastomeric block copolymers herein are block copolymers which have a similar room temperature behavior to conventional elastomers, but are plastically deformable on heating and thus exhibit a thermoplastic behavior. These thermoplastic and elastomeric block copolymers have subregions with physical points of crosslinking (for example, secondary valency forces or crystallites) which become unlinked on heating without the polymer molecules decomposing.

Component c) comprises selected particles of carbon black and/or of graphite. The carbon blacks or graphites in question have primary particles which are arranged in the form of aggregates which preferably have the form of a clew, in particular in the form of elongated strands. The carbon blacks used according to the present invention consist of nanoscale primary particles. These are generally spherical and typically have diameters in the range from 10 to 300 nm. Owing to the pronounced anisotropy of the aggregates of carbon black particles or graphite platelets that are used according to the present invention, longitudinally oriented aggregates form in the course of the spinning of the strand, and form electrically conductive paths along the longitudinal axis of the strand. In the undrawn strand, these aggregates are partly present in dewed form and are extended in the longitudinal direction of the strand, but not ruptured, by the drawing operation. The electrically conductive paths in the strand thus remain intact.

Particular preference for use as components c) is given to carbon blacks which are present in the strand in the form of elongate aggregates constructed of a plurality of primary particles in contact with one another, and which endow the drawn strand with an electrical conductivity of at least $0.5*10^{-6}$ siemens/cm and preferably at least $1.0*10^{-5}$ siemens/cm, measured in the longitudinal direction of the strand.

The amounts of components a), b) and c) in the strands of the present invention can be chosen within wide limits. The strands typically contain 20% to 70% by weight of component a), 15% to 40% by weight of component b) and 5% to 50% by weight of component c), all based on the total mass of the strand.

The combination of components a), b) and c) which is used according to the present invention endows the strands not only with excellent abrasion resistance but also with good textile-technological properties, in particular good dynamic properties and an excellent dimensional stability, and also with outstanding electrical conductivity.

The components a), b) and c) used for producing the strands of the present invention are known per se, partly commercially available or obtainable by processes known per se.

The strands of the present invention, as well as components a), b) and c), may further comprise further, adjunct materials d).

Examples thereof include, in addition to the aforementioned hydrolysis stabilizer, processing aids, antioxidants, plasticizers, lubricants, pigments, delusterants, viscosity modifiers or crystallization accelerants.

Examples of processing aids are siloxanes, waxes or comparatively long-chain carboxylic acids or their salts, aliphatic, aromatic esters or ethers.

Examples of antioxidants are phosphorus compounds, such as phosphoric esters or sterically hindered phenols.

Examples of pigments or delusterants are organic dye pigments or titanium dioxide.

Examples of viscosity modifiers are polybasic carboxylic acids and their esters or polyhydric alcohols.

The strands of the present invention can be present in any desired form, for example as multifilaments, as staple fibers, as secondarily spun yarns, including in the form of threads, or particularly as monofilaments.

In a particularly preferred embodiment, the strands of the present invention are in the form of multicomponent strands. Examples thereof are side-by-side strands or, in particular, sheath-core strands. The sheath in the sheath-core strands preferably consists of a composition comprising components a), b), c) and, if appropriate, d), while the core consists of a fiber-forming polymer which determines the mechanical properties, chiefly the strength and breaking extension, of the overall strand.

A particularly preferred combination is a sheath-core strand whose core consists of polyester, preferably of polyethylene terephthalate, and whose sheath contains the components a), b), c) and, if appropriate, d).

In preferred sheath-core strands, the weight ratio of core and sheath is in the range from 95:5 to 20:80, preferably in the range from 75:25 to 45:55 and especially in the range from 70:30 to 50:50.

The linear density of the strands according to the present invention can vary within wide limits. Examples thereof are 1 to 45 000 dtex and especially 100 to 4000 dtex.

The cross-sectional shape of the strands according to the present invention is freely choosable, examples being round, oval or n-gonal, where n is not less than 3.

The strands of the present invention are obtainable by processes known per se.

A typical production process comprises the measures of: i) extruding a mixture comprising components a), b) and c) through a spinneret die, ii) withdrawing the resulting filament, iii) drawing and iv) if appropriate, relaxing the resulting filament.

Multicomponent strands are produced in a similar manner. Except that in this case the spinning dopes which form the different compositions are melted in different extruders and pressed through a multicomponent spinneret die.

The composition containing components a), b), c) and, if appropriate, d) is preferably used in the form of a master batch.

The strands of the present invention are subjected to drawing, in one or more stages, in the course of their production.

It is particularly preferable to produce the strands using as component a) and/or as component of the core strand a polyester produced by solid state condensation.

After the polymer melt has been forced through a spinneret die, the hot strand of polymer is quenched, for example in a quench bath, preferably in a water bath, and subsequently wound up or withdrawn. The withdrawal speed is greater than the ejection speed of the polymer melt.

The strand thus produced is subsequently subjected to an afterdrawing operation in one or more stages, if appropriate, set and wound up, as known from the prior art for the melt-spinnable polymers mentioned.

The strands of the present invention are preferably used for producing textile fabrics, particularly woven fabrics, spiral fabrics, nonwoven scrims or drawn-loop knits. These textile fabrics are preferably used in screens.

Textile fabrics comprising the strands of the present invention likewise form part of the subject matter of this invention.

The strands of the present invention can be used in all industrial fields. They are preferably employed for applications where increased wear due to mechanical stress and also a buildup of static electricity is likely. Examples thereof are the use in screen wovens and filter cloths for gas and liquid filters, in drying belts, for example in the manufacture of food products, in packaging containers or in hoses for conveying small particles. These uses likewise form part of the subject matter of the present invention.

A further use of the strands of the present invention in the form of monofilaments concerns their use as conveyor belts or as components of conveyor belts.

The strands of the present invention may also be used in screens which are wire screens and intended for use paper-making machines.

These uses likewise form part of the subject matter of the present invention.

The examples which follow elucidate the invention without limiting it.

EXAMPLES

General Working Description for Producing Sheath-Core Monofilaments of Examples 1 to 2

The component for the core, polyethylene terephthalate (PET), was melted in an extruder. The components for the sheath, PET and a masterbatch (Deltacom PET 1917 EC3, from Delta Kunststoffe Produktions-und Handelsgesellschaft mbH, Weeze, Germany) of PET, thermoplastic elastomer, conductivity carbon black and additives were mixed and melted in another extruder. The melted spinning dopes from the two extruders were spun in a bicomponent spinneret die having 20 holes 1.0 mm in diameter at a feed rate of 488 g/min and a withdrawal speed of 31 m/min to form monofilaments having a sheath-core structure, which were drawn, and heat set in a hot air duct at 255° C. with shrinkage being allowed. The textile-technological data of the monofilaments obtained are shown in Table 1.

A grade of PET with an IV value of 0.72 dl/g was used.

The masterbatch consisted of 50% by weight of the PET type described above and also 27% by weight of a thermoplastic, elastomeric styrene block copolymer, 20% by weight of a conductivity carbon black and 3% by weight of processing stabilizer, lubricant, sterically hindered amine and silane. A commercially available, antistatic monofilament (Horner AIX from Albany Group) served as comparison.

TABLE 1

| Monofilaments | | | |
|---|---|---|---|
| | Example 1[1)] | Example 2[1)] | Comparative example |
| Tensile strength (cN/tex) | 20.8 | 20.4 | 13.6 |
| Modulus of elasticity (GPa) | 11.8 | 10.6 | 11.8 |
| Elastic extension (%) | 1.3 | 1.4 | 1.3 |
| Breaking extension (%) | 32.5 | 60.6 | 31.3 |
| Linear density (dtex) | 2715 | 2703 | 4483 |
| el. resistance (S/cm) | $1.6 * 10^{-5}$ | $1.8 * 10^{-5}$ | $6.6 * 10^{-6}$ |

[1)]The products of Examples 1 and 2 differ in the thermofixing

Fiber properties were determined as follows:

tensile strength in accordance with DIN EN/ISO 2062 breaking extension in accordance with DIN EN/ISO 2062

Electrical conductivity was determined as follows:

The monofilament was clamped between two jaws under slight pre-tension, and silverized at two positions. Electrical clamps connected to a resistance meter (Metra Hit 15 S; measuring range up to 30 MΩ) were attached at the silverized locations. The clamp spacing chosen was between 10 mm and 300 mm. A clamp spacing of 100 mm has been used as standard. The resistance per cm, i.e., Ω/cm, was measured. The conductivity value is the reciprocal resistance for 1 centimeter of monofil length.

Example: R=620 kΩ/10 cm corresponds to R=62 kΩ/cm corresponds to $L=1.6*10^{-5}$ S/cm.

While the invention has been described in connection with several examples, modifications to those examples within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A melt-spun strand having a modulus of elasticity of from 8 to 14 GPa and an elastic extension of up to 1.5%, comprising:

a) a thermoplastic polyester, b) a thermoplastic elastomeric block copolymer, and c) carbon black and/or graphite particles in the form of aggregates aligned along the longitudinal axis of the strand which form electrically conductive paths along the longitudinal axis of the strand.

2. The strand according to claim 1, wherein component a) is a polyethylene terephthalate homopolymer or a polyethylene terephthalate copolymer which, as well as polyethylene terephthalate units, contains units which are derived from aliphatic, cycloaliphatic or aromatic dicarboxylic acids or polyester-forming derivatives thereof and from aliphatic or cycloaliphatic dialcohols.

3. The strand according to claim 1, wherein component b) is a thermoplastic polyurethane elastomer, a thermoplastic polyester elastomer, thermoplastic styrene block copolymer or a combination of two or more thereof.

4. The strand according to claim 1, wherein component b) is a thermoplastic, elastomeric styrene block copolymer.

5. The strand according to claim I, wherein component c) is a carbon black which is present in the strand in the form of elongate aggregates constructed of a plurality of primary particles in contact with one another, and which effects an electrical conductivity for the strand of at least $0.5*10^{-6}$ siemens/cm, measured in the longitudinal direction of the strand.

6. The strand according to claim 1, wherein the strand is a sheath-core strand whose core is formed of polyester and whose sheath contains components a), b) and c).

7. The strand according to claim 6, wherein the polymer of component a) is a polyester and the weight ratio of core and sheath is in the range from 95:5 to 20:80.

8. The strand according to claim 1, being a monofilament.

9. A textile fabric, comprising strands according to claim 1.

10. The textile fabric according to claim 9, which comprises further strands of polyester.

11. The strand according to claim 1, wherein component b) is a thermoplastic, elastomeric styrene block copolymer chosen from the group consisting of: a styrene-butadiene-styrene block copolymers; styrene-ethylene-butadiene-styrene block copolymer; and combinations thereof.

12. The strand according to claim 11, wherein component b) is a thermoplastic, elastomeric styrene-butadiene-styrene block copolymer.

13. The strand according to claim 11, wherein component b) is a thermoplastic, elastomeric styrene-ethylene-butadiene-styrene block copolymer.

14. The strand according to claim 1, wherein component c) is a carbon black which is present in the strand in the form of elongate aggregates constructed of a plurality of primary particles in contact with one another, and which effects an electrical conductivity for the strand of at least $1.0*10^{-5}$ siemens/cm, measured in the longitudinal direction of the strand.

15. The strand according to claim 6, wherein the polymer of component a) is a polyester and the weight ratio of core and sheath is in the range from 75:25 to 45:55.

16. The strand according to claim 6, wherein the polymer of component a) is a polyester and the weight ratio of core and sheath is in the range from 70:30 to 50:50.

17. A woven textile fabric, comprising strands according to claim 1.

18. The textile fabric according to claim 17, which comprises further strands of polyester.

19. The textile fabric according to claim 17, which comprises further strands of polyethylene terephthalate.

20. The textile fabric according to claim 9, which comprises further strands of polyethylene terephthalate.

21. A process for filtering comprising passing a fluid admixture through a reticulum comprising a strand according to claim 1.

22. A process for drying comprising passing a fluid through a reticulum comprising a strand according to claim 1.

23. A process for drying a food product comprising passing a fluid through a reticulum comprising a strand according to claim 1 having food product supported thereupon.

24. A process for conveying small particles comprising the step of providing a hose comprising a strand according to claim 1 having small particles disposed therein.

25. A process for conveying objects comprising the step of providing an endless translating belt comprising a strand according to claim 1 having objects disposed thereupon.

* * * * *